US005330412A

United States Patent [19]

Stephens

[11] Patent Number: 5,330,412

[45] Date of Patent: Jul. 19, 1994

[54] BOWLING ALLEY PIT ASSEMBLY AND BOUNCE BOARD

[75] Inventor: Michael W. Stephens, Richmond, Va.

[73] Assignee: AMF Bowling, Inc., Mechanicsville, Va.

[21] Appl. No.: 90,310

[22] Filed: Jul. 13, 1993

[51] Int. Cl.[5] ..... A63D 5/00

[52] U.S. Cl. ..... 473/93; 473/99; 198/837

[58] Field of Search ..... 273/37, 42 R, 43 R, 273/47, 48, 49, 53; 198/837, 842, 841; 473/54, 73, 93, 106, 110, 111, 112, 114, 98, 99, 94

[56] References Cited

U.S. PATENT DOCUMENTS

| | | | |
|---|---|---|---|
| 3,237,943 | 3/1966 | Congelli | 273/49 |
| 3,317,207 | 5/1967 | Jark et al. | 273/43 R |
| 3,880,424 | 4/1975 | Bockelman | 273/43 R |
| 4,426,078 | 1/1984 | Alonzo | 273/43 R |
| 5,238,242 | 8/1993 | Edwards | 273/37 |

*Primary Examiner*—Vincent Millin
*Assistant Examiner*—William M. Pierce
*Attorney, Agent, or Firm*—Bacon & Thomas

[57] ABSTRACT

A bowling alley pit assembly for transferring bowling pins and balls to a pin elevator and ball return includes a base member having a forward and rear portion and a pair of laterally-spaced walls. The base member is disposed in a pit area of the bowling alley with the forward portion adjacent to the pin deck and the rear portion adjacent a pin elevating mechanism. A pair of rollers are disposed between the spaced walls and a motor is operatively connected to one of the rollers. A pit-wide endless belt passes around the rollers for moving fallen pins rearwardly away from the pin deck. The pit assembly also includes a one-piece or unitary, generally hollow, plastic bounce board disposed between the upper and lower portions of the endless belt and between the pair of rollers. The bounce board is transverse to the alley and defines two side-by-side, relatively flat portions which slope downwardly to form a shallow trough with a recessed area at one end thereof. The bounce board also includes a plurality of reinforcing members therein which support the upper panel or surface thereof.

11 Claims, 5 Drawing Sheets

BOWLING ALLEY PIT ASSEMBLY AND BOUNCE BOARD

FIELD OF THE INVENTION

This invention relates to a bowling alley pit assembly for transferring bowling pins and balls to a pin elevator and ball return and, more particularly, to a unitary bounce board for supporting a moving carpet within a bowling alley pit assembly and for directing bowling balls into the ball return.

BACKGROUND OF THE INVENTION

Bowling pins and balls typically arrive in a pit area under considerable force and must be separated with the pins being fed to a pin distributer and spotter while the bowling balls are delivered to a ball return. For this reason, it is customary to provide a conveyor or travelling pit wide apron as disclosed in the U.S. Pat. No. 3,526,401 to Zuercher et al. In such systems, a pit assembly includes a pit-wide belt or endless carpet which travels on a pair of parallel rollers. These rollers are transverse of the pit and mounted in a lower position thereof so that the top portion of the belt moves rearwardly and carries the fallen pins to the pin elevating mechanism. The mechanism, which is at the back of the pit, carries or lifts the pins upwardly to a pin distribution system for delivery to a pin spotter.

The apparatus normally found in a bowling alley pit includes a pair of wood bounce boards which are disposed immediately below the top portion of the belt and between the pair of rollers. The bounce boards support the top portion of the belt and are designed to withstand considerable forces. Bowling balls and pins frequently strike the belt in the area which is supported by the bounce boards which then absorb the impact. Nevertheless, these bounce boards are prone to breakage and are relatively difficult to replace. Also, in typical installations, the replacement of the bounce boards takes considerable time and may result in an alley being shut down during peak times.

In most of the modern bowling centers, the alleys are disposed in a side-by-side arrangement with each pair of alleys separated by a ball return mechanism such as the one disclosed in U.S. Pat. No. 5,076,582 of Edwards, entitled "Bowling Ball Lifting Apparatus," which is assigned to the same assignee as the present invention. Such centers also typically incorporate pin elevating mechanisms at the rear of the pit assembly as well as a pin distribution system above the pit and an accompanying pin spotter above the pin deck. Consequently, there is very little room for making adjustments or repairs to the pit assembly. As a result, a pair of alleys may be taken out of service for a considerable time because of a broken bounce board.

In a typical alley, the bounce boards are of different size and are designed for a left or right side alley. For example, it is necessary to stock a forward and rear bounce board for the alley on the left and the same for the alley on the right. For this reason, it is necessary to have four spare bounce boards for the possible breakage of a single board.

It has now been found that a pit assembly and bounce board in accordance with the present invention facilitates repairs and replacement of pit assemblies and bounce boards, reduces the number of spare parts in inventory as well as the number of parts in a pit assembly. In addition, the pit assemblies and bounce boards disclosed herein offer a cost advantage since fewer parts are involved, have improved durability, minimal weight, are easy to install, universal and retrofittable to many if not most alleys.

BRIEF SUMMARY OF THE INVENTION

The present invention contemplates a bowling alley pit assembly for transferring bowling pins and balls to a pin elevator and ball return. The pit assembly includes a base or base member having a forward and rear portion and a pair of laterally spaced walls. The base member is positioned in a pit area at one end of a longitudinal bowling alley with the forward portion adjacent to the pin deck of the bowling alley and with the rear portion adjacent to a pin elevating mechanism. A pair of rotatable rollers is disposed between the laterally spaced walls and a motor and drive means operatively connected to the motor to rotate one of the rollers. An endless belt passes over and around the rollers for rotation therewith with the top portion of the belt moving in a direction away from the pin deck and toward the pin elevating mechanism so that fallen pins will be carried rearwardly toward the pin elevating mechanism. A ball deflecting means which includes a universal one piece or unitary bounce board is disposed between the upper and lower portions of the endless belt and between the pair of rollers. The bounce board is transverse to the alley and designed to receive repeated impacts from falling pins and bowling balls which fall onto or strike the endless belt. The top portion of the endless belt moves across or over the bounce board and moves fallen pins from the pit to a pin spotter. The pit assembly also includes means for adjusting the tracking of the endless belt.

The bounce board, in accordance with a preferred embodiment of the invention, comprises a unitary elongated plastic structure having upper and lower surfaces and a generally rectangular shape. The upper surface defines two side-by-side, relatively flat, longitudinally extending portions which slope downwardly toward the center of the upper surface and which define an obtuse angle at the intersection of the elongated portions. The longitudinally extending portions also define an outwardly diverging recessed area at one end thereof for receiving and positioning a bowling ball with respect to a ball return mechanism. In the preferred embodiment of the invention, the bounce board comprises a generally hollow structure and includes reinforcing means molded therein.

DESCRIPTION OF THE PREFERRED EMBODIMENT OF THE INVENTION

Figure 1:
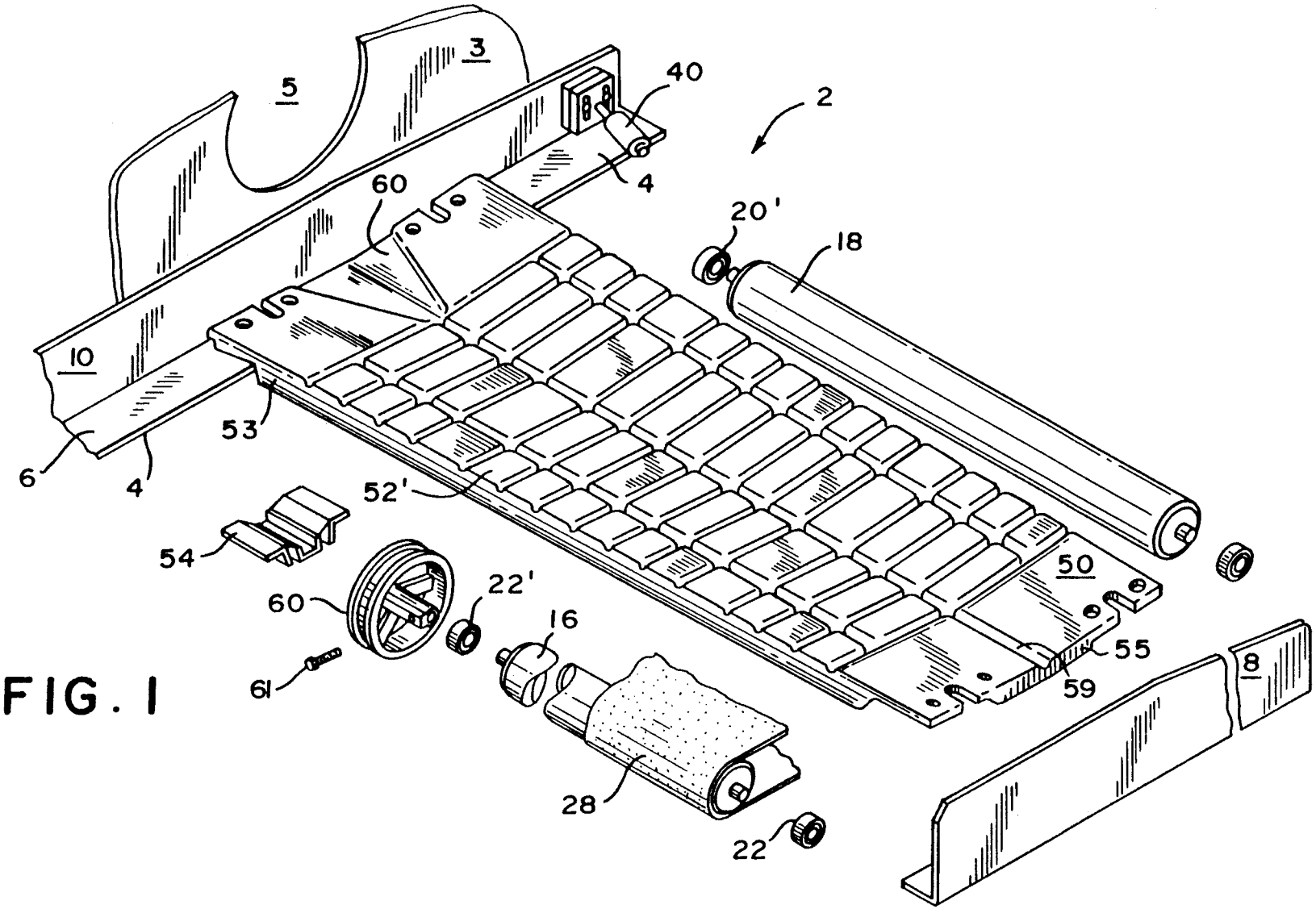
FIG. 1 is an exploded perspective view illustrating various parts from a bowling alley pit assembly in accordance with the present invention.

The invention will now be described in connection with the accompanying drawings wherein like reference numerals have been used to designate like parts.

An improved pit assembly and bounce board in accordance with the present invention may be in modular form, as disclosed and claimed in a copending application of Gardner Ulrich Edwards, Ser. No. 07/559,084, entitled "Modular Bowling Alley Pit Assembly," assigned to the same assignee as the present invention and incorporated herein in its entirety by reference. The improved pit assembly and bounce board may also be employed in the more conventional or stationary form or pit assembly. In fact, the improved bounce board as disclosed herein may be readily incorporated in many of the existing pit assemblies.

Figure 2:
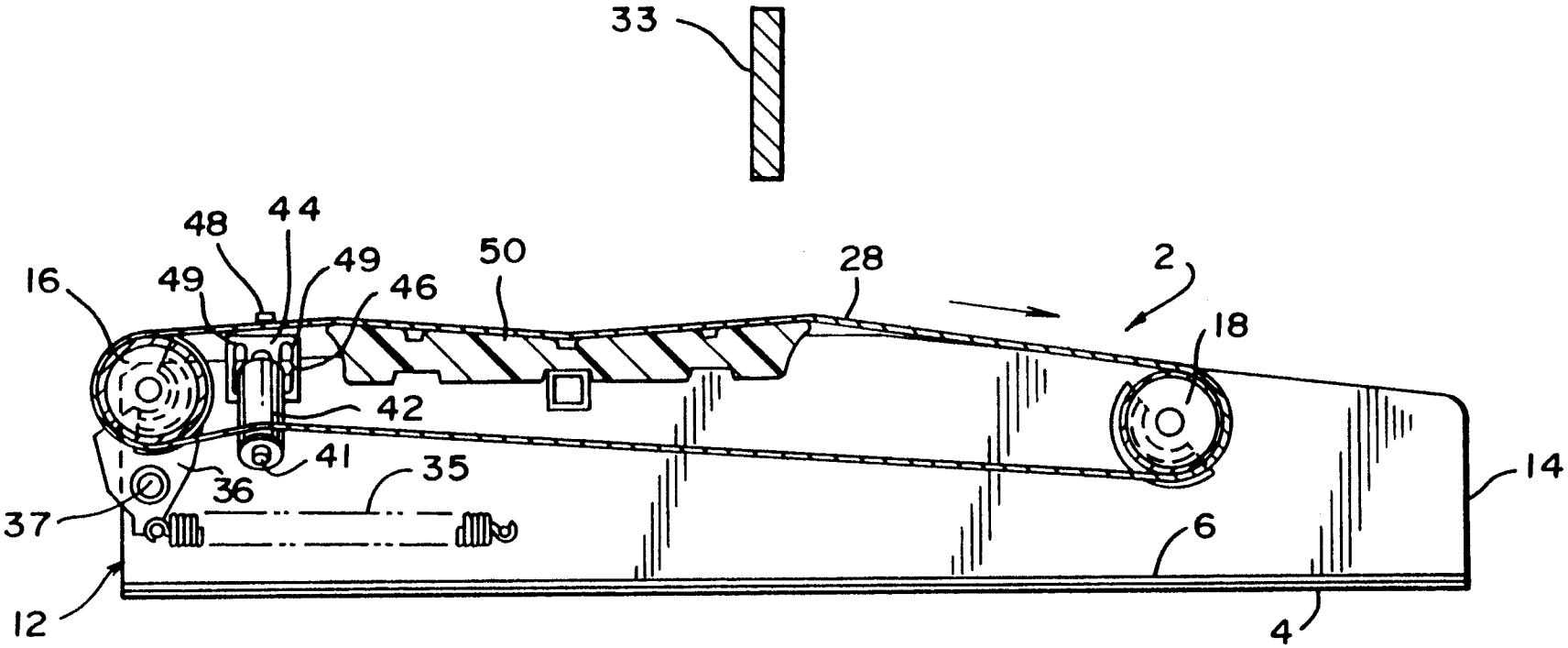
FIG. 2 is a cross-sectional view of the bowling alley pit assembly shown in FIG. 1.
Figure 3:
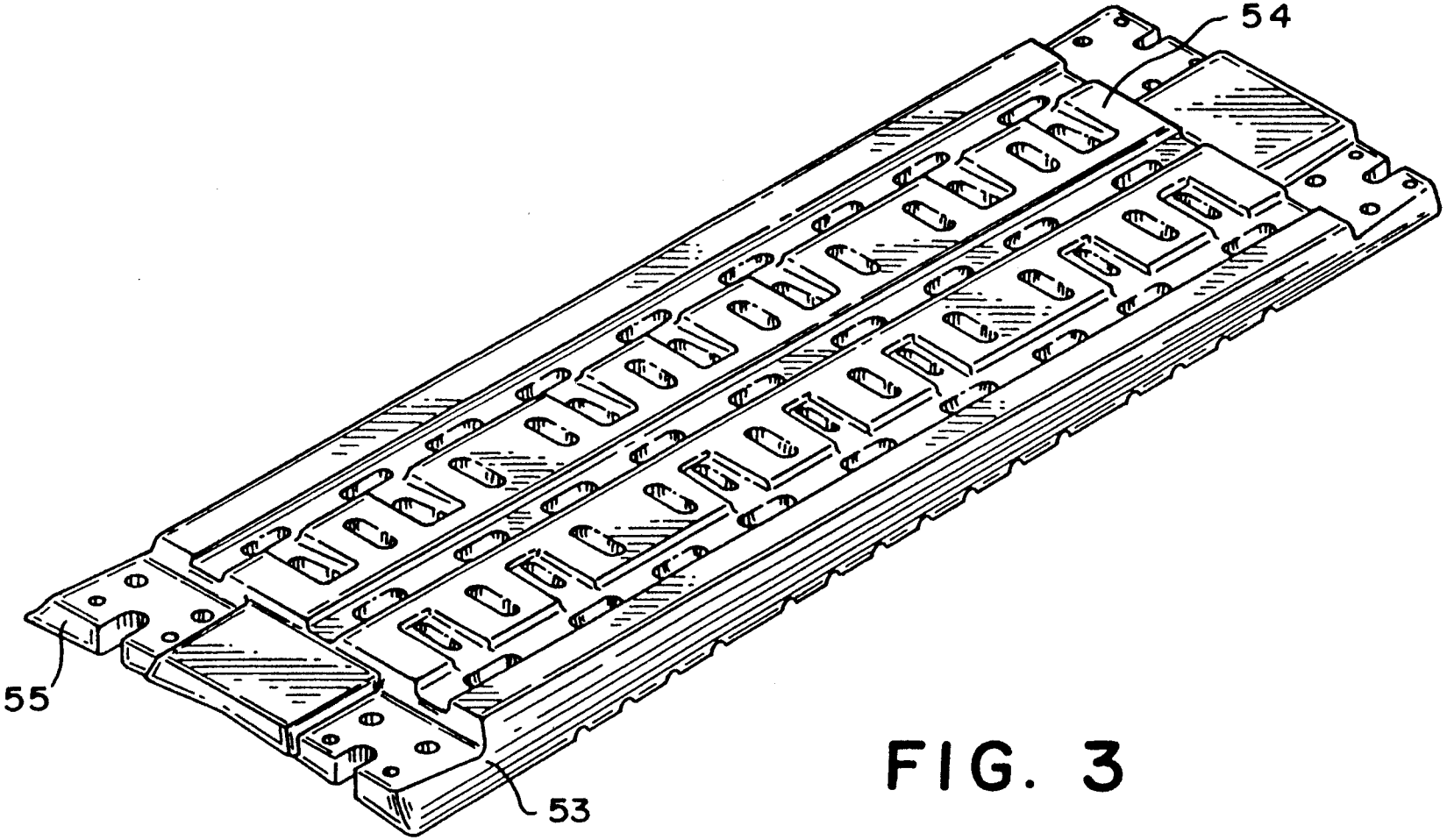
FIG. 3 is a perspective view illustrating the bottom of the bounce board shown in FIG. 1.
Figure 4:
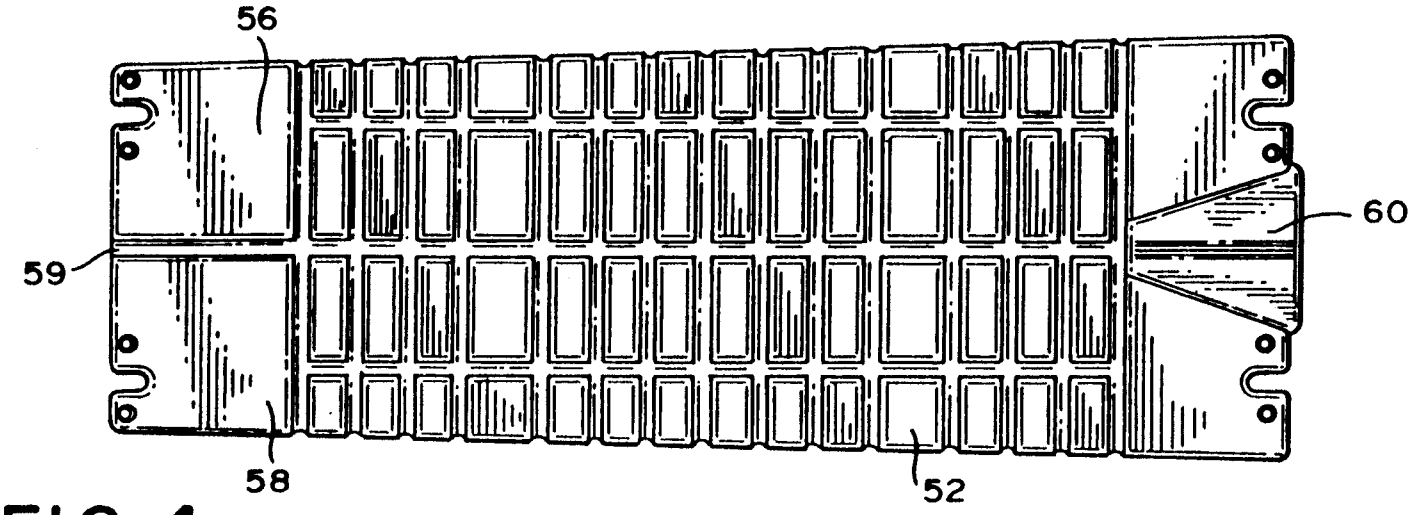
FIG. 4 is a top or plan view of the bowling alley bounce board shown in FIG. 1.

A pit assembly 2 in accordance with the present invention is illustrated in modular form in FIGS. 1 and 2. This assembly 2 is disposed at the rear of a conventional bowling alley adjacent to the pin deck and between a pair of side walls or kick backs 3 which cause flying pins and balls to fall into the pit. One of such kick backs normally include an opening or door 5 in a lower portion thereof for receiving bowling balls and allowing the balls to be returned to a bowler in a manner which is described in the United States patent of Edwards, U.S. Pat. No. 5,076,582, for a "Bowling Ball Lifting Apparatus," incorporated herein in its entirety by reference. An alternative ball return mechanism is disclosed in Zuercher et al., U.S. Pat. No. 2,765,172, which is also incorporated herein in its entirety by reference. The pit assembly 2 is disposed in front of and immediately adjacent a pin elevating mechanism or assembly (not shown) which is adapted to receive pins from the rear of the pit assembly and lift those pins upwardly to a pin distributor and spotter (not shown).

The modular pit assembly 2 includes a tray 4 or drawer-like structure having a base member or portion 6 and a pair of laterally spaced walls 8,10. The tray 4 also includes a forward portion 12 and rear portion 14 and is constructed and arranged for positioning in the pit area at one end of a bowling alley. The tray 4 is also constructed and arranged so that its forward portion 12 can be disposed immediately rearwardly of the pin deck of an alley (not shown) and the rearward portion 14 will be immediately forward of a pin elevating mechanism or assembly. The assembly 2 also includes a pair of laterally disposed rotatable parallel rollers 16,18 which are disposed in suitable bearing assemblies 20,20', 22,22' disposed on side walls 8,10. A lateral brace member and cross-braces (not shown) provide added rigidity or structural support for the tray 4.

An endless pit-wide belt or carpet 28 passes over and around rollers 16 and 18 for rotation therewith. The belt 28 moves in the direction of the arrow so that the upper or top surface of belt 28 moves the pins rearwardly away from the pin deck and toward a pin elevating mechanism. This top surface of the belt is generally parallel to the surface of the alley but somewhat below that surface.

The modular pit assembly also operates in conjunction with a ball deflecting means 33 which is not generally a part of the modular pit assembly 2. The ball deflecting means 33 prevents a bowling ball from moving rearwardly thereof but allow fallen pins to pass freely thereunder. Consequently, a bowling ball will be moved laterally toward the ball elevating mechanism in a manner as will be described hereinafter.

The pit assembly 2 also includes spring tension means 35 which act in conjunction with pivotal member 36 and pivot 37 for maintaining the endless belt 28 under tension. This pivotal member 36 is essentially a crank arm mounted on shaft or pivot 37 and exert pressure against bearing assembly 20.

A pair of angularly disposed tracking rollers 40 (one shown) are adjustably mounted on side walls 8,10. The rollers 40 preferably extend downwardly and inwardly to form an angle of about 45° off of vertical as illustrated in FIG. 2. As shown, the tracking rollers comprise a downwardly extending shaft 41 having a roller 40 rotatably mounted thereon and held in place by an end cap assembly. The shaft 41 is fixed to a mounting bracket 44 and held to the side wall by bolts 46. An adjusting means or screw 48 is constructed and arranged to move the roller 42 upwardly or downwardly along the vertical axis for aligning the endless belt 28 and providing proper tracking thereof. A pair of vertical channels 49 are constructed and arranged in member 44 so that the roller assembly 42 can be moved by means of screw 48. In practice, a tool such as a socket and ratchet with an extension can be used to make appropriate adjustments in the tracking rollers without removing the modular assembly 2 from the pit.

The modular assembly 2 also includes a laterally extending unitary bounce board 50, which is carried on a rectangular channel mount 52 by means of a rubber shock mount (not shown). The unitary bounce board 50 comprises a generally hollow plastic structure having upper and lower panels 52 and 54, side walls 53 and end walls 55. The upper panel 52 defines an upper surface 52' which includes a plurality of generally rectangular raised segments and a series of recesses. The upper surface 52' also defines two side-by-side, relatively flat, laterally-extending portions 56 and 58 which are laterally extending with respect to the bowling lane or alley.

The portions 56 and 58 slope downward toward the middle of the upper surface and form a trough, an obtuse angle at the intersection of the laterally extending portions 56 and 58. Those portions 56 and 58 may, for example, meet at a laterally extending channel 59. In a preferred embodiment of the invention, the internal angle formed by extensions of portions 56 and 58 is about 165°. In the preferred embodiment of the invention, the upper surface 52' also defines a generally triangular shaped outwardly diverging recessed area 60 at one end thereof for receiving and positioning a bowling ball with respect to the opening or gate 5. This recessed area 60 preferably increases in depth as it approaches the base of the triangle, i.e., as it approaches or is closest to gate 5.

The bounce board 50 is offset slightly, i.e., tilted toward gate 5, so that a bowling ball will fall into a shallow trough formed by the sloping portions 56 and 58 so that the bowling ball will roll or be directed toward gate 5. Thus, with the longitudinal movement of the belt, the trough tends to cradle the bowling ball and it is thus moved laterally toward a ball lift mechanism (not shown). The trough is slightly angled in order to direct the ball toward one side of the pit and serves to initiate movement of the ball for its return to a bowler by directing the ball toward and through opening or door 5 for engagement by the mechanism disclosed in the aforementioned Edwards patent. As illustrated, a suitable drive means such as pulley 60 is connected by means of a hex drive 61 to rotatable roller 18 and belt 28 by means of a motor and belt (not shown).

The bowling alley bounce board 50 is preferably made of a high density polyethylene or other plastic which exhibits sufficient strength, light weight and durability to withstand repeated impacts from bowling balls and pins. The finish of upper surface 52' is also slightly textured or grainy which allows the pit-wide carpet to pass over the bounce board with minimal drag.

Figure 5:
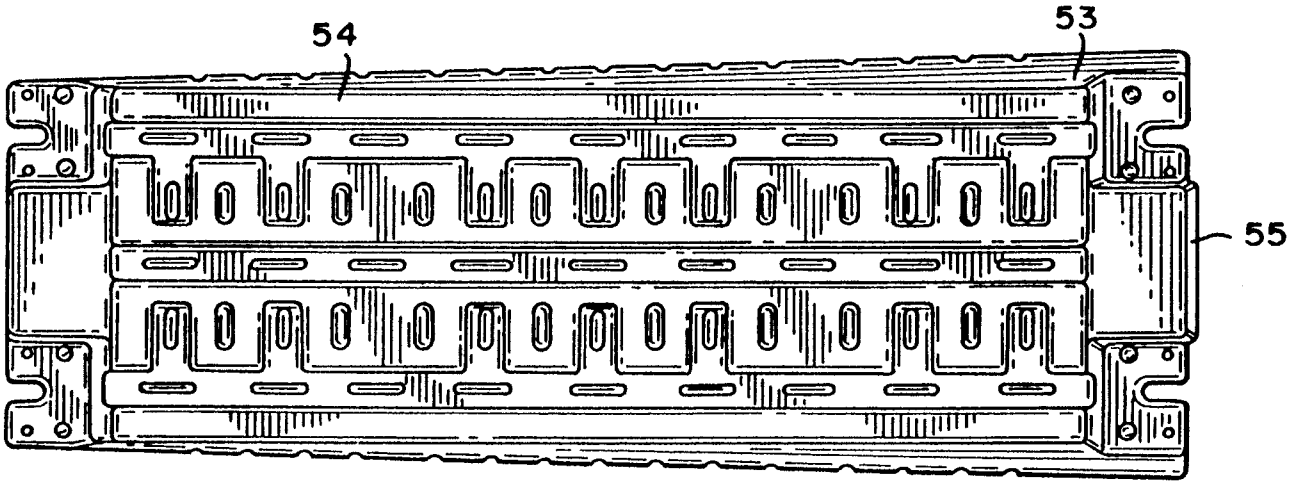
FIG. 5 is a bottom view of the bowling alley bounce board shown in FIGS. 1, 3 and 4.
Figure 6:
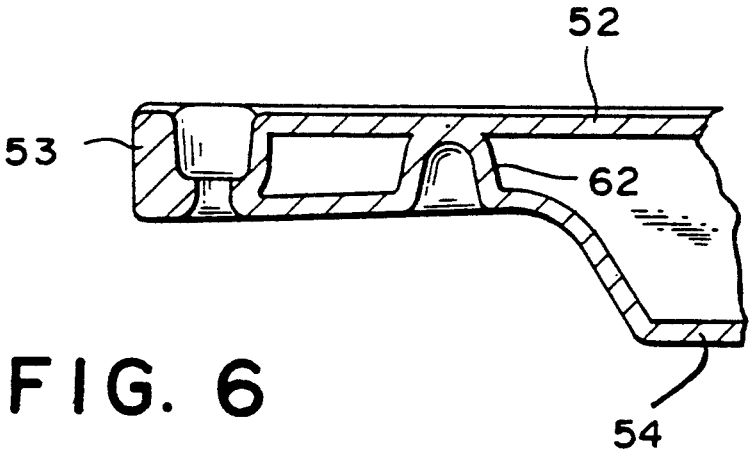
FIG. 6 is a cross-sectional view illustrating the hollow construction of a first portion of a bowling alley bounce board in accordance with a preferred embodiment of the invention.
Figure 7:
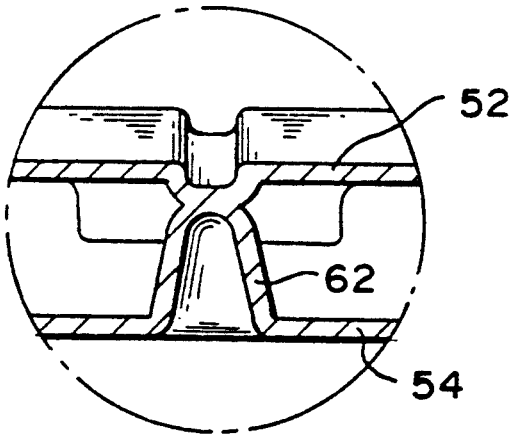
FIG. 7 is a cross-sectional view illustrating the hollow construction of a second portion of a bowling alley bounce board in accordance with a preferred embodiment of the invention.

As illustrated more clearly in FIGS. 5, 6 and 7, the bounce board 50 includes a number of internal supports 62 which are formed by a plurality of indentations in lower panel 54. For example, the indentation or reliefs in lower panel 54 form vertical support members 62 for upper panel 52. These supports provide added strength and durability to the structure.

In addition, the generally hollow structure reduces the cost of raw materials, the weight of the board and provides added flexibility as well as resistance to cracking.

While the invention has been described in connection with one of its preferred embodiments, it should be understood that changes and modifications may be made without departing from the scope of the appended claims.

What is claimed is:

1. A bowling alley pit assembly for transferring bowling pins and balls which fall from an adjacent pin deck to a pin elevator and ball return comprising a base member, a forward and rear portion of said base member and a pair of laterally spaced walls, said base member positioned between said laterally spaced walls in a pit area at one end of a longitudinal bowling alley with said forward portion adjacent to the pin deck of the bowling alley and with said rear portion adjacent to a pin elevating mechanism, a pair of rotatable rollers disposed between said walls, a motor and means operatively connecting said motor to one of said rollers for rotation thereof, an endless belt passing over and around said rollers for rotation therewith with a top surface of said belt moving in a direction away from the pin deck and toward the pin elevating mechanism so that fallen pins will be carried rearwardly toward the pin elevating mechanism, ball deflecting means including a unitary bounce board for guiding a ball laterally across said belt away from the pin elevating mechanism and toward a ball return mechanism, and means for adjusting the position of one of said roller tracking means, said bounce board comprising a unitary elongated plastic structure having upper and lower surfaces, said upper surface including a raised, generally rectangular pattern and a plurality of relatively shallow channels thereon and having two side-by-side relatively flat, longitudinally extending portions which slope downwardly toward the center of said upper surface and which define an obtuse angle at the intersection of said elongated portions, said longitudinally extending portions also having an outwardly diverging recessed area at one end thereof for receiving a bowling ball therein and said lower portions including reinforcing means molded therein.

2. A bowling alley pit assembly according to claim 1 in which said bounce board comprises a generally hollow structure having upper and lower panels and a plurality of internal supports between said upper and lower panels.

3. A bowling alley pit assembly according to claim 2 in which said lower panels include a series of raised portions on an inner side thereof and wherein those raised portions on the inner side thereof are in contact with and support said upper panel.

4. A bowling alley pit assembly according to claim 3 in which said bounce board is constructed of a high-density polyethylene.

5. A bowling alley pit assembly according to claim 3 in which said upper surface of said bounce board has a textured finish which allows a moving carpet to pass over the bounce board with minimal drag.

6. A bounce board for use in a bowling alley pit assembly comprising a unitary elongated plastic structure defining upper and lower surfaces, said upper surface defining two side-by-side relatively flat, longitudinally extending portions which slope downwardly toward the center of said upper surface and which define an obtuse angle at the intersection of said elongated portions, said longitudinally extending portions also having an outwardly diverging recessed area at one end thereof for receiving a bowling ball therein; and said upper surface including a raised pattern with a plurality of relatively shallow channels therebetween.

7. A bounce board for use in a bowling alley pit assembly in accordance with claim 6 in which the plastic structure is a high density polyethylene.

8. A bounce board for use in a bowling alley pit assembly in accordance with claim 6 which includes means defining a longitudinally extending channel along the center of said upper surface.

9. A bounce board for use in a bowling alley pit assembly in accordance with claim 6 in which said bounce board comprises a generally hollow structure having upper and lower panels and a plurality of internal supports between said upper and lower panels.

10. A bounce board for use in a bowling alley pit assembly in accordance with claim 6 in which said lower panels include a series of raised portions on an inner side thereof and wherein those raised portions on said inner side are in contact with and support said upper panel.

11. A bounce board for use in a bowling alley pit assembly in accordance with claim 6 in which said bounce board is constructed of a high-density polyethylene.

* * * * *